United States Patent [19]

Fenne

[11] Patent Number: 4,624,231

[45] Date of Patent: Nov. 25, 1986

[54] FUEL INJECTION PUMPING APPARATUS

[75] Inventor: Ivor Fenne, Greenford, England

[73] Assignee: Lucas Industries public limited company, Birmingham, England

[21] Appl. No.: 551,251

[22] Filed: Nov. 14, 1983

[30] Foreign Application Priority Data

Dec. 8, 1982 [GB] United Kingdom ..... 8234945

[51] Int. Cl.[4] ..... F02M 39/00

[52] U.S. Cl. ..... 123/450; 123/467; 417/462

[58] Field of Search ..... 123/450, 467, 506; 417/462, 463

[56] References Cited

U.S. PATENT DOCUMENTS

| | | | |
|---|---|---|---|
| 3,592,568 | 7/1971 | Fenne | 123/467 |
| 3,910,244 | 10/1975 | Skinner | 123/450 |
| 4,232,644 | 11/1980 | Potter | 123/450 |
| 4,336,781 | 6/1982 | Overfield | 123/467 |

FOREIGN PATENT DOCUMENTS

| | | | |
|---|---|---|---|
| 1394996 | 5/1975 | United Kingdom | 123/450 |
| 2041442 | 9/1980 | United Kingdom | 123/450 |

*Primary Examiner*—Carl Stuart Miller

[57] ABSTRACT

A fuel injection pumping apparatus of the rotary distributor type has a distributor member rotatable within an angularly adjustable sleeve carried in the body of the apparatus. The sleeve is coupled to an angularly adjustable cam ring having internal lobes operable to impart pumping movement to a plunger carried in a bore in the distributor member. The distributor member has a delivery passage connected to the bore for registration with outlets in turn to the sleeve. The distributor member also has a further and restricted passage which registers with the outlet which has just received fuel for the purpose of absorbing pressure waves which may be reflected back to the outlet from the associated injection nozzle. The fact that the sleeve and cam ring are connected to each other means that as timing variation is effected by moving the cam ring angularly the phasing between the outlets, the delivery passage and the further passage remains constant.

5 Claims, 3 Drawing Figures

FUEL INJECTION PUMPING APPARATUS

This invention relates to liquid fuel injection pumping apparatus for supplying fuel to multi-cylinder internal combustion engines of the compression ignition type, the apparatus being of the kind comprising an injection pump operated in use, in timed relationship with an associated engine, a rotary distributor member having a delivery passage communicating with the injection pump and arranged to register in turn as the distributor member rotates, with a plurality of outlets during successive delivery strokes of the injection pump and a delivery valve in said delivery passage.

The outlets of the apparatus are connected by pipelines respectively to the injection nozzles of the associated engine and as is well known, the injection nozzles include spring biased valve members which are lifted from their respective seatings by the fuel under pressure supplied by the injection pump.

A known problem with fuel injection systems is the fact that when the valve members in the nozzles close, pressure waves travel along the pipelines towards the pumping apparatus and can be reflected back towards the nozzles to cause so-called "secondary injection". It is known with apparatus of the aforesaid kind to provide "snubber valves" in the outlets respectively. Each snubber valve comprises a one-way valve and a by-pass orifice, the orifice acting to damp the pressure wave generated upon closure of the valve member of the nozzle. It is also known in an apparatus having a single delivery valve in the distributor member to provide an orifice in the distributor member and to so position the orifice that it communicates with the outlets during the periods of time the pressure wave is received at the apparatus. The orifice communicates with a space which is constituted by the portion of the delivery passage downstream of the delivery valve. By careful choice of the size of the orifice damping of the reflected pressure wave can be obtained. However, in most forms of apparatus of this type it is necessary to adjust a component of the injection pump in order to modify the timing of fuel delivery by the apparatus. When this is the case the communication of the aforesaid orifice with the outlets does not always occur at the correct time to absorb or damp the reflected pressure wave.

The object of the present invention is to provide an apparatus of the kind specified in an improved form.

According to the invention an apparatus of the kind specified comprises a sleeve member surrounding the distributor member, said sleeve member defining said outlets, said sleeve member being angularly adjustable about the axis of rotation of the distributor member and being coupled to an adjustable component of the injection pump which varies the timing of delivery of the fuel by the injection pump, a further passage opening onto the periphery of the distributor member for registration with said outlet ports in turn and a restricted orifice in said further passage, said further passage registering when an outlet following the registry therewith of the delivery passage, said orifice acting to damp the reflected wave produced by closure of the valve member in the associated nozzle.

An example of a fuel injection pumping apparatus in accordance with the invention will now be described with reference to the accompanying drawings in which.

Figure 1:
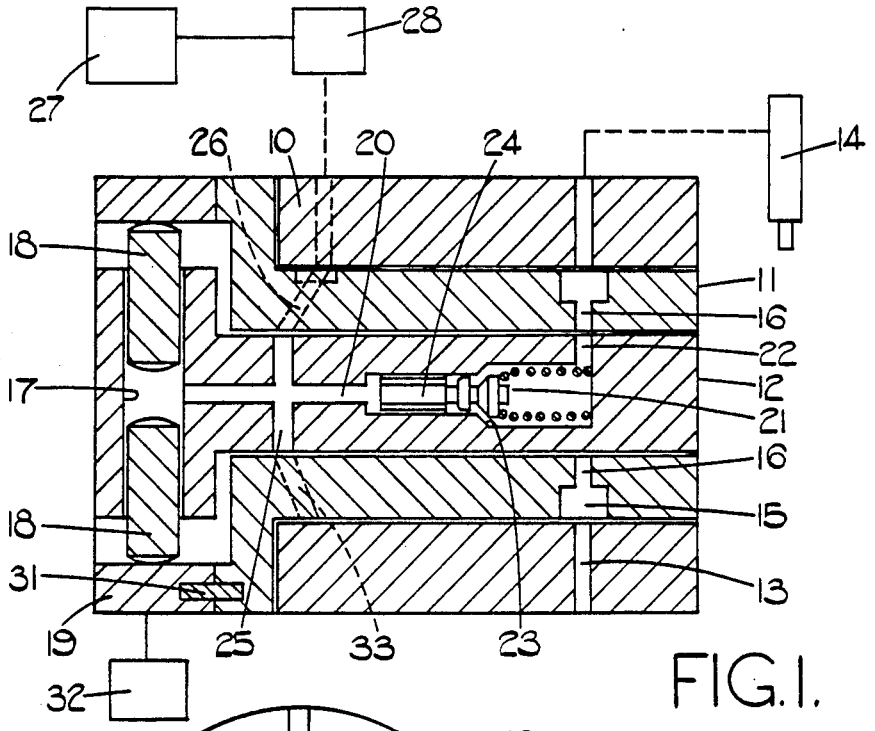
FIG. 1 is a sectional side elevation of the pumping apparatus.
Figure 2:
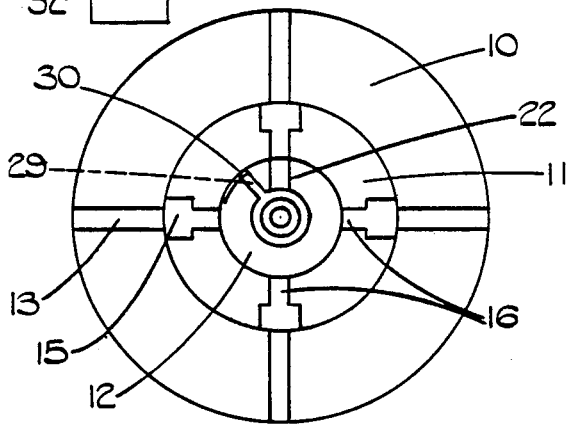
FIG. 2 is a section of part of the apparatus shown in FIG. 1.

Referring to FIGS. 1 and 2 of the drawings the apparatus comprises a body part 10 in which is mounted an angularly movable sleeve 11. The sleeve accommodates a rotary distributor member 12 which is connected to a shaft not shown, whereby it can be driven in timed relationship with an associated multi-cylinder compression ignition engine.

Formed in the body 10 are a plurality of outlet passages 13 which communicate respectively with injection nozzles 14 mounted on the associated engine to direct fuel into the respective combustion chambers of the engine. The outlet passages 13 communicate respectively with enlarged openings 15 on the periphery of the sleeve, the openings communicating with the respective passages throughout as will be explained, the range of angular movement of the sleeve 11. The openings 15 communicate with outlet passages 16 opening onto the periphery of the distributor member 12.

Formed in a portion of the distributor member exterior of the sleeve 11, is a transversely extending bore 17 in which is mounted a pair of reciprocable pumping plungers 18. In a practical construction, the plungers at their outer ends would engage cam followers which in turn co-operate with cam lobes formed on the internal peripheral surface of an annular cam ring 19 carried within the body of the apparatus. The profiles of the cam lobes 19A are shown in developed form, in FIG. 3.

The transverse bore 17 communicates with an axially extending passage formed in the distributor member, this passage being referenced 20. The passage 20 has a slightly enlarged portion which opens into a chamber 21 defined in the distributor member and from which extends a delivery passage 22, the delivery passage being positioned to register with the outlet ports 16 in turn. The junction of the enlarged portion of the passage with the chamber 21 defines a seating 23 for a delivery valve member generally indicated at 24 and which includes a head located in the chamber 21 and biased by means of a coiled compression spring into contact with the seating 23.

Upstream of the delivery valve the passage 20 communicates with a plurality of inlet passages 25 which can communicate in turn with an inlet port 26 formed in the sleeve 11 and which is in constant communication with an inlet passage formed in the body part 10, this passage communicating with a lower pressure fuel supply pump 27 by way of a fuel control device 28.

Ignoring for the moment the sleeve 11, the apparatus as described functions in a well known manner. Wben the plungers 18 are moved inwardly by the cam lobes 19A, fuel under pressure flows through the passage 20 to lift the delivery valve and is delivered to an outlet port 16 through the delivery passage 22. As the distributor member continues to rotate, inward movement of the plungers ceases and the delivery passage moves out of register with the delivery port. Following continued rotation of the distributor member, an inlet passage 25 is brought into register with the inlet port 26 and fuel can flow to the bore 17 to effect outward movement of the plungers. The amount of fuel supplied to the bore 17 is dependent upon the setting of the control device 28 which may be an adjustable throttle.

When the delivery of fuel by the plungers 18 ceases, the delivery valve 24 will close but during such movement a volume of fuel is allowed to flow from the connected pipeline to permit rapid closure of the valve member in the associated nozzle.

As explained above rapid closure of the valve member in the nozzle can produce a pressure wave in the column of fuel and this pressure wave will encounter the closed or closing delivery valve and may be reflected back towards the nozzle where it can cause secondary injection of fuel.

In order to minimise this problem the apparatus as described is provided as shown in FIG. 2, with a restricted additional passage which communicates with the space 21. The additional passage is referenced 29 and it opens onto a groove 30 formed on the periphery of the distributor member. The dimensions of the passage 22 and the outlet port 16 are such that in the particular example, the groove 30 is brought into communication with an outlet port 16 just before the delivery passage 22 is moved out of register with the outlet. Moreover it is arranged that the groove 30 is brought into communication with the outlet just before the plungers 18 have completed their inward movement. The practical effect of positioning the groove 30 in the manner described is that the fuel which is returned from the pipeline flows through the passage 29 and since this contains an orifice, the rate at which fuel is unloaded from the pipeline can be controlled. In addition, the aforesaid orifice acts to damp any pressure waves which may be generated.

Figure 3:
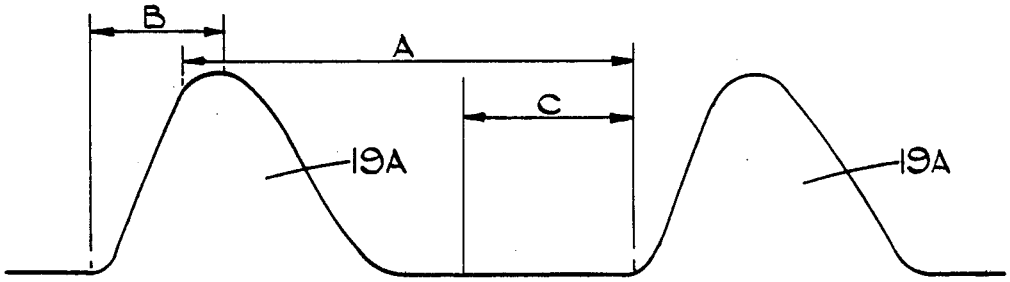
FIG. 3 is a diagram representing the cam profile of a part of the apparatus seen in FIG. 1.

With apparatus of the aforesaid kind it is necessary to provide for angular adjustment of the cam 19 in order to be able to vary the instant at which the plungers 18 are moved inwardly. In order that the timing relationship between the outlet ports and the passage 22 and groove 30 is not disturbed, the sleeve 11 is angularly movable with the cam. In the example the cam 19 is coupled to the sleeve 11 by means of a pin 31 and the cam and sleeve are movable angularly by means of an actuator 32. This has the practical effect of allowing the ports 16 and the passage 22 together with the port 26 and the inlet passages 25 to be of a diameter which is related to the shape of the cam lobes 19A. In normal apparatus the ports have to be of sufficient size to accommodate variations in the timing of delivery of fuel. As seen in FIG. 3, the groove 30 is in register with an outlet port during the period which is indicated by the reference letter A. The delivery passage 22 is in register with an outlet port 16 during the period indicated by the reference letter B and the inlet port 26 is in register with an inlet passage 25 during the period indicated by the reference letter C. With the arrangement described, the aforesaid periods are maintained whatever the setting of the cam 19.

From FIG. 3 it will be seen that in the case of a pumping apparatus for supplying fuel to a four cylinder engine, the groove 30 remains in communication with an outlet 16 for approximately 70° and this allows ample time for the pressure wave to be absorbed.

In a modification, a spill port 33 communicating with a drain is formed in the sleeve 11 and is positioned so as to be opened toone of the inlet passages 25 at a position just before the plungers 18 have been moved inwardly their maximum extent. The effect of this is to depressurise the fuel contained in the passage 20 upstream of the delivery valve and also in the bore 17 thereby terminating delivery of fuel before the cam follower moves over the crest of the cam lobe. The effect of this is to minimise the mechanical stress on the crest of the cam lobe and also to terminate delivery of fuel before the rate of injection of fuel reduces as the cam follower starts to approach the crest of the cam lobe.

The apparatus as described allows the passage 29 to be connected to an outlet for an extended period in the case of a four cylinder pump, for about 75°, thereby allowing for full absorption of pressure waves. The apparatus should also exhibit improved injection regularity as the volume of fuel carried in the rotor should be substantially constant. Phasing variations should also be reduced and there is the ability to control the rate of closure of the valves in the injection nozzles by choosing the size of the orifice in the passage 29. Moreover in the case where the apparatus incorporates a spill port, it is possible to terminate delivery of fuel before the cam followers reach the crests of the cam lobes.

I claim:

1. A fuel injection pumping apparatus for supplying fuel to multi-cylinder internal combustion engines of the compression ignition type, the apparatus comprising an injection pump operated in use, in timed relationship with an associated engine, a rotary distributor member having a delivery passage communicating with the injection pump and arranged to register in turn as the distributor member rotates, with a plurality of outlets during successive delivery strokes of the injection pump, a delivery valve in said delivery passage, a sleeve member surrounding the distributor member, said sleeve member defining said outlets and being movably mounted to be angularly adjustable about the axis of rotation of the distributor member, an adjustable cam ring forming part of the injection pump which is movably mounted and operable to vary the timing of delivery of the fuel by the injection pump, means coupling said sleeve member to said cam ring for moving said sleeve in correspondence with adjustment of said cam ring whereby the positional relationship between said cam ring and said sleeve remains essentially constant throughout the range of adjustment of said cam ring, a further passage opening onto the periphery of the distributor member for registration with said outlet ports in turn and a restricted orifice in said further passage, said passage registering with an outlet following the registry therewith of the delivery passage, said orifice acting to damp the reflected wave produced by closure of the valve member in the associated nozzle.

2. An apparatus according to claim 1 in which said adjustable cam comprises an annular cam ring surrounding a portion of the distributor member exterior of said sleeve member, said portion of the distributor member defining a bore in which is mounted a reciprocable plunger actuated by cam lobes on said cam ring, said bore communicating with said delivery passage and said further passage.

3. An apparatus according to claim 2 including a delivery valve positioned between said bore and said passages.

4. An apparatus according to claim 2 or claim 3 in which said sleeve member is coupled by a pin to said cam ring so as to be movable angularly therewith.

5. A liquid fuel injection pumping apparatus for supplying fuel to multi-cylinder internal combustion engines of the compression ignition type, the apparatus comprising an injection pump operated in use, in timed relationship with an associated engine, a rotary distributor member having a delivery passage communicating with the injection pump and arranged to register in turn as the distributor member rotates, with a plurality of outlets during successive delivery strokes of the injection pump, a delivery valve in said delivery passage, a sleeve member surrounding the distributor member, said sleeve member defining said outlets, said sleeve member being angularly adjustable about the axis of rotation of the distributor member and being coupled to an adjustable component of the injection pump which varies the timing of delivery of the fuel by the injection pump, a further passage opening onto the periphery of the distributor member for registration with said outlet ports in turn and a restricted orifice in said further passage, said further passage registering when an outlet following the registry therewith of the delivery passage, said orifice acting to damp the reflected wave produced by closure of the valve member in the associated nozzle, and further passage means in the distributor member and sleeve member, said further passage means being disposed upstream of the delivery valve and being arranged to vent said bore to a drain at a predtermined position during the inward movement of the plunger.

* * * * *